United States Patent [19]

Stockman et al.

[11] 4,160,414

[45] Jul. 10, 1979

[54] PROJECTILE HAVING A DELAY-ACTION FIRING MECHANISM

[76] Inventors: Suzanne Stockman; Leon Stockman, both of Avenue des Aubépines, 156, 1180 Brussels, Belgium

[21] Appl. No.: 803,859

[22] Filed: Jun. 6, 1977

[30] Foreign Application Priority Data

Jun. 10, 1976 [BE] Belgium ..... 167781
Mar. 31, 1977 [BE] Belgium ..... 176279

[51] Int. Cl.[2] ..... F42C 15/02; F42C 15/24

[52] U.S. Cl. ..... 102/65.2; 102/251; 102/254

[58] Field of Search ..... 102/65.2, 236, 244, 102/251, 254

[56] References Cited

FOREIGN PATENT DOCUMENTS 2520117 11/1975 Fed. Rep. of Germany ..... 102/251

*Primary Examiner*—Verlin R. Pendegrass
*Attorney, Agent, or Firm*—Becker & Becker, Inc.

[57] ABSTRACT

A rifle grenade including a delay-action firing mechanism including a striker, a detonator carried by a barrel, and a striker blocking device with inertia unlocking on shooting of the grenade. The barrel includes an annular element bearing upon a stationary abutment when the barrel is in a safety position, the abutment preventing the barrel from rotating in a wrong direction when it is released by the striker.

20 Claims, 4 Drawing Figures

PROJECTILE HAVING A DELAY-ACTION FIRING MECHANISM

The present invention relates to improvements in a projectile or missile, such as a rifle grenade, comprising a firing mechanism of the delay-action type.

A heretofore known firing mechanism of the said type comprises a striker arranged along the axis of the projectile and protruding beyond the front of the latter, a detonator associated with the striker and fired thereby when the front of the grenade meets an obstacle, and an explosive charge fired by the detonator, the latter being movably mounted between a safety position and an operating position permitting the firing of the charge when the grenade has been launched.

The detonator is arranged in a central bore of a rotary barrel capable of pivoting about an axis perpendicular to the longitudinal axis of the grenade, the center of gravity of the barrel being shifted with respect to its pivot axis so as to constitute a compound pendulum allowing the detonator to be moved from its safety position to its operating position merely under the action of an inertia force directed approximately along the axis of the grenade and resulting from its slowing down under the action of air resistance. The lower part of the striker is provided with a pointed protuberance which engages into a blind hole provided in the barrel and directed radially perpendicular to the bore containing the detonator. A blocking device with inertia unlocking upon discharge of the grenade holds the striker and the barrel in a safety position preventing the firing of the charge in case of percussion so long as the grenade has not covered a certain distance from its firing point.

The present invention relates to improvements in the grenade firing mechanism described hereabove as well as in the grenade itself, directed mainly at improving and stabilizing the beginning of the trajectory of the grenade at the moment of firing of the shot and at additionally increasing the period of time between the firing of the shot and the moment the striker is brought to its operating position.

To this end the invention provides a rifle grenade including a firing mechanism of the type described above, characterized in that the barrel is provided with an annular or otherwise suitably shaped element, e.g., at least partially of stainless metal, attached to the barrel and protruding therefrom to form a surface by which the said barrel in safety position bears upon the edges of the orifice or passage leading to the explosive charge of the grenade, so that when the barrel is in safety position the said annular element bears upon a first stationary abutment preventing the barrel from rotating in the wrong direction when it is released by the striker.

According to the invention the said annular element therefore serves both as an element through which the barrel bears on its seat in safety position and as an abutment for preventing random rotation of the barrel in a direction opposite to its normal direction of rotation, which would have an undesirable influence on the duration of rotation of the barrel between its safety position and its operating position.

According to another characteristic feature of the invention, the grenade tail tube by which the grenade is fitted to the rifle barrel is provided with an outlet opening for the propelling gases, the said opening being so directed as to impart a predetermined maximum-value inclination to the grenade at the beginning of its trajectory.

Indeed, the following undesirable drawback has been observed upon discharge of the grenade: when the grenade propelled by the gas pressure in the rifle barrel leaves the end of the latter there appears between the end of the rifle barrel and the end of the grenade tail tube an annular gap through which the gases escape outside in a non-uniform manner, resulting in a random and absolutely undetermined modification of the inclination of the grenade at the beginning of its trajectory. This phenomenon causes an undetermined oscillation of the grenade on its trajectory from the very beginning of the launching.

The invention allows this drawback to be remedied by imparting a predetermined maximum-value inclination to the grenade at the beginning of its trajectory, which inclination may vary between zero and a predetermined maximum value.

The invention will be better understood and other purposes, characteristic features, details and advantages of the latter will appear more clearly from the following explanatory description made with reference to the appended diagrammatic drawings given solely by way of example illustrating one form of embodiment of the invention and wherein.

Figure 1:
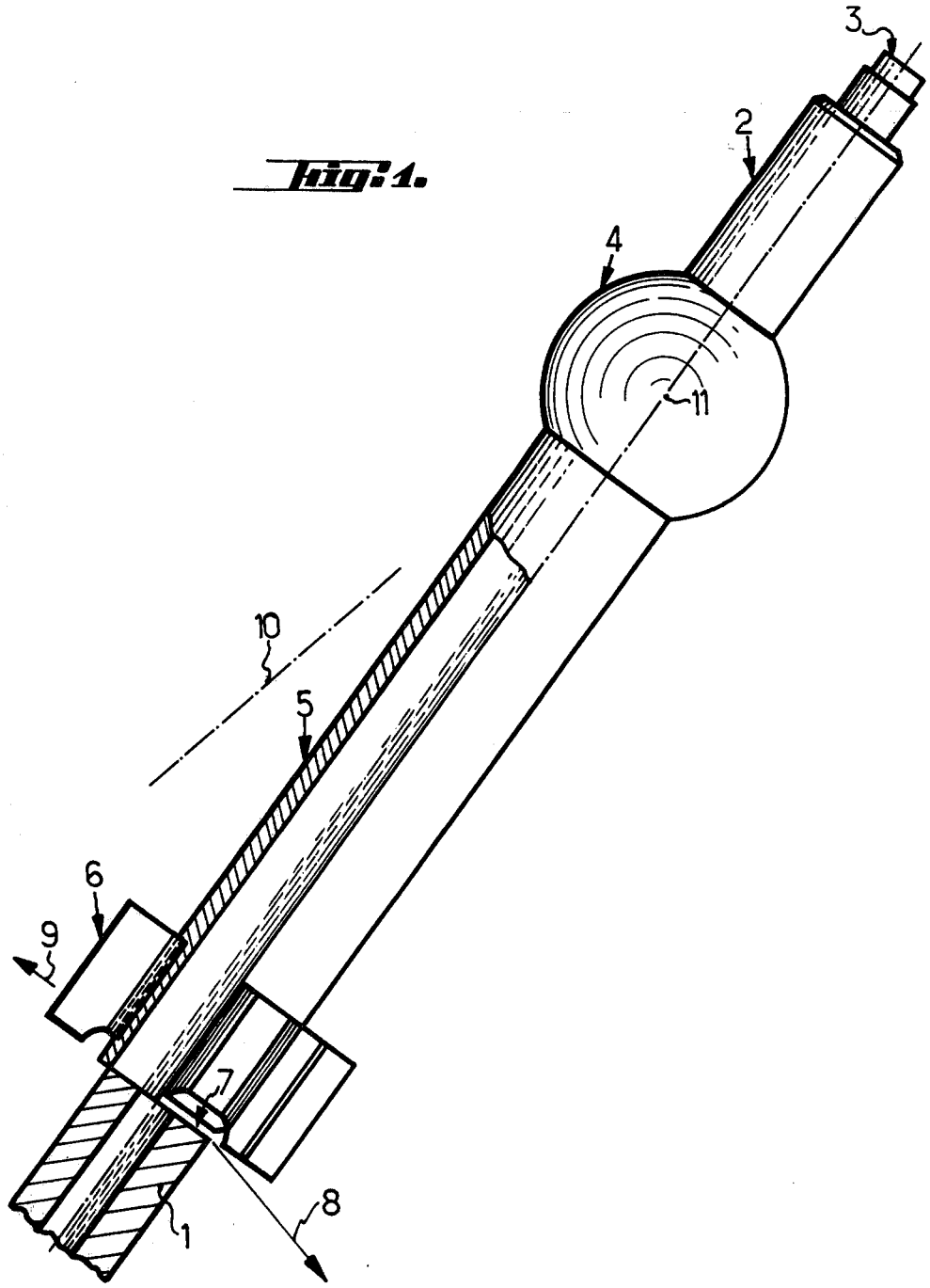
FIG. 1 is a diagrammatic, partially broken-away view of a rifle grenade according to the invention, shown at the moment it is leaving the end of the rifle barrel.

In FIG. 1 the grenade is therefore shown quite diagrammatically just at the moment it is leaving the end of the rifle barrel 1. The grenade comprises essentially a nose 2 from the top of which protrudes the end 3 of the striker, a bulge 4 in which is accommodated the explosive charge and a tail tube 5 provided at its lower end with a fin assembly 6. In order to fire the grenade, the lower end of the tail tube 5 is fitted to the end of the rifle barrel 1 and use is made, for example, of a blank cartridge. The cartridge combustion gases, which form the gases for propelling the grenade, fill up the rifle barrel 1 and the tail tube 5 and project the grenade forward.

As provided by the present invention, a notch or cut 7, e.g., semi-circular in shape, is formed at the bottom portion of tail tube 5 so as to provide a preferential outlet opening for the propelling gases as indicated by arrow 8. This preferential outlet for the propelling gases at the moment the grenade is leaving the rifle barrel 1 results in a push on the lower end of the grenade in the direction indicated by arrow 9. The grenade at the beginning of its trajectory is thus imparted the inclination shown diagrammatically by the axis line 10.

By thus allowing the grenade to assume at the beginning of its trajectory a predetermined maximum inclination shown by the line 10, any random oscillation of the grenade at the beginning of its trajectory, as occurred in the prior art, is avoided.

It will be noted that the axis line 10 shows the maximum inclination which the grenade can assume with respect to the axis of the beginning of its theoretical trajectory, materialized by the longitudinal axis 11 of the grenade, and that at the moment the shot is fired the grenade may actually assume any inclination comprised between the inclination of axis 11 and that of axis 10.

This starting impulse imparted to the grenade by the preferential outflow of the propelling gases through the notch 7 affects the behavior of the barrel. The present invention also has for its purpose to control the influence of this starting impulse on the behavior of the barrel and to take care that this influence does not modify the constant and predetermined duration of rotation of the barrel in passing from its safety position to its operating position.

Figure 2:
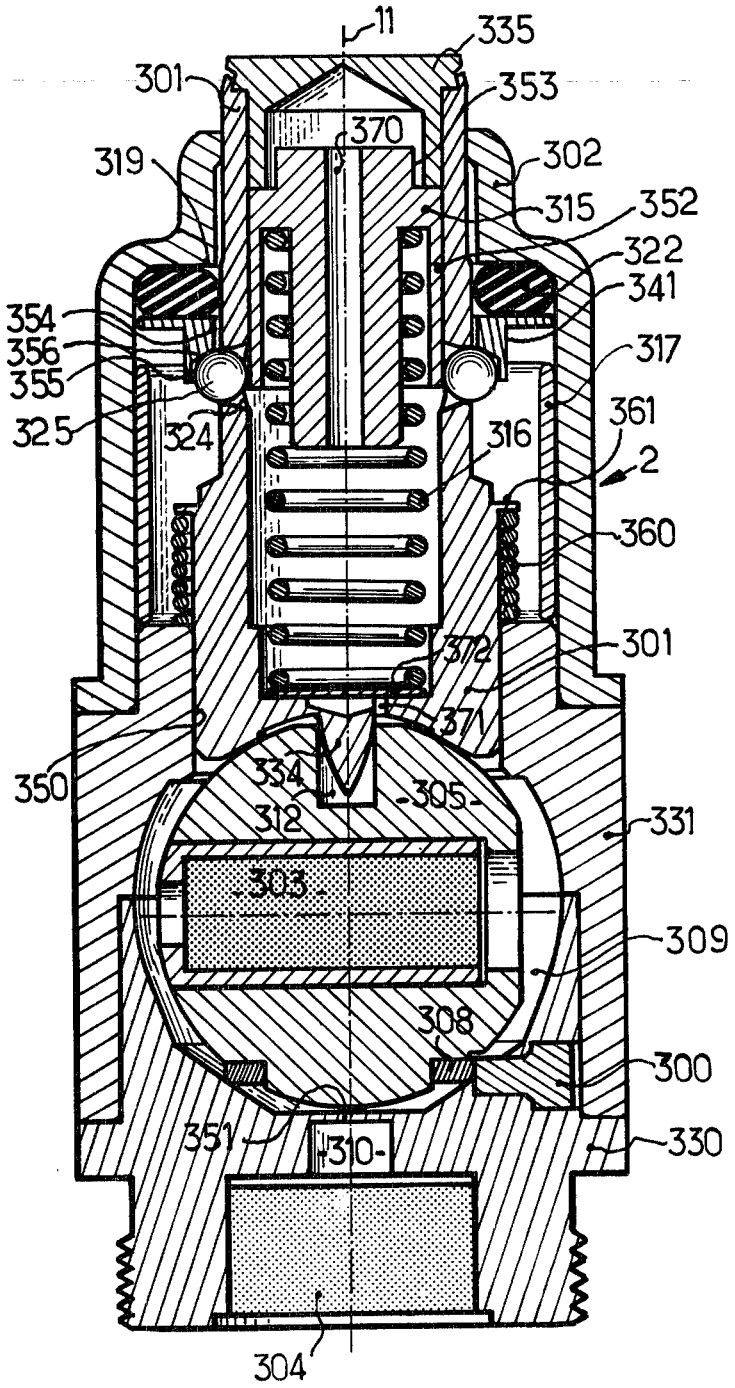
FIG. 2 is an axial sectional view of the grenade nose, showing the striker and the rotary barrel in their safety positions.
Figure 3:
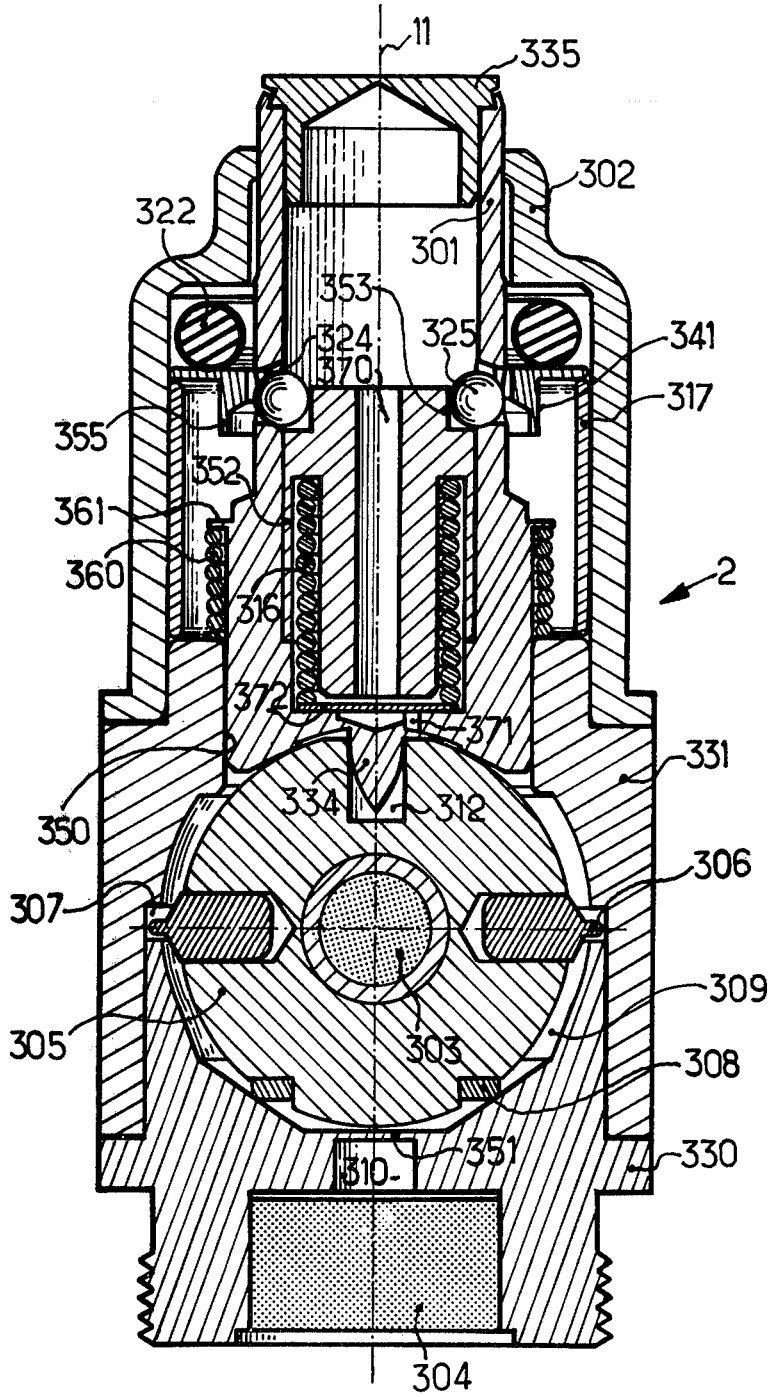
FIG. 3 is also a sectional view of the grenade nose in a section plane perpendicular to the section plane of FIG. 2, showing the condition of the inertia blocking device upon firing the shot.
Figure 4:
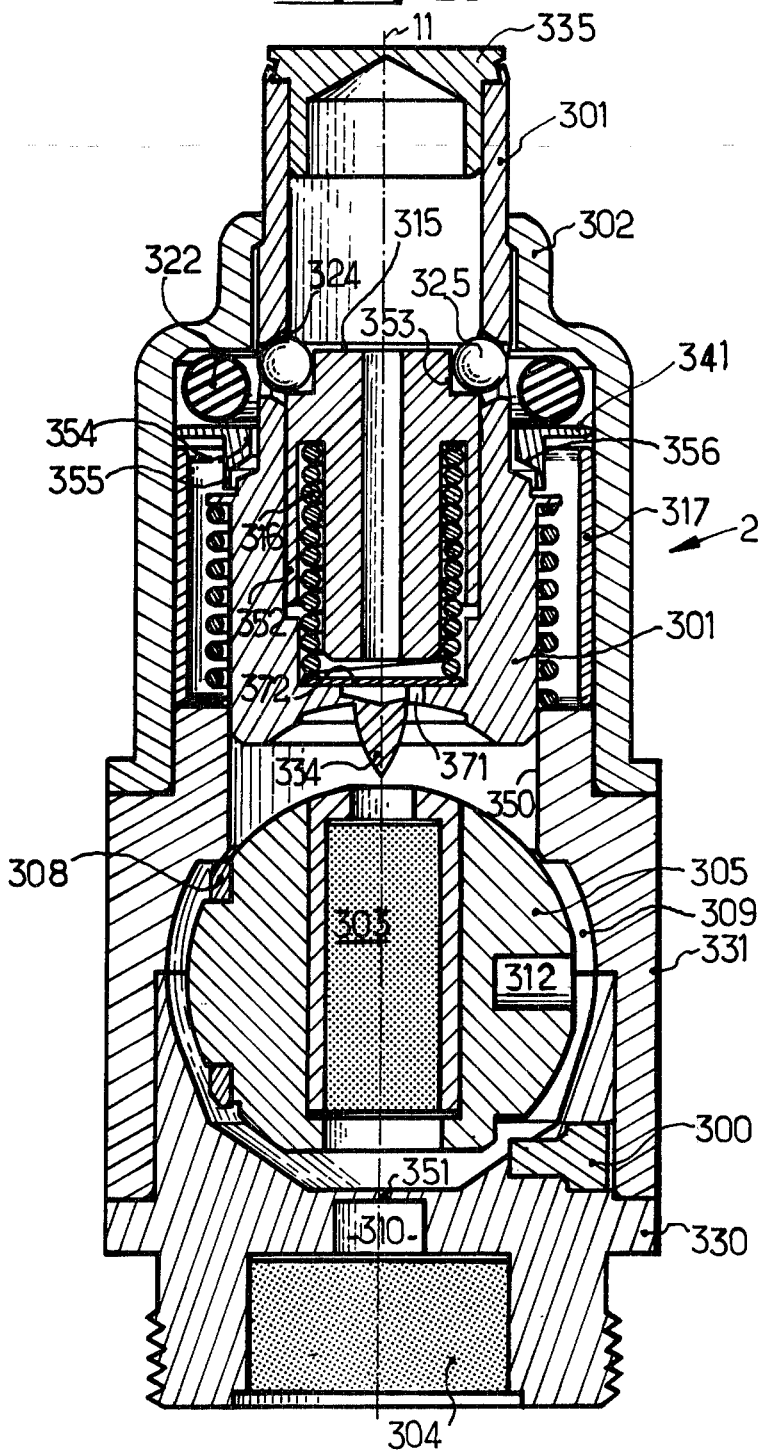
FIG. 4 is an axial sectional view of the grenade nose in the same section plane as FIG. 2, showing the detonator and the striker in their operating positions.

FIGS. 2, 3 and 4 are axial sectional views of the grenade nose 2, showing the striker, the barrel and the blocking device with inertia unlocking.

The nose fuze 2 of the grenade comprises an axial striker 301 protruding beyond the front portion 302 of the grenade and sliding longitudinally within that portion. The detonator 303 accommodated in the diametral bore of the barrel 305 is placed between the pointed protuberance 334 of the striker lower portion and the charge 304 of the grenade. The barrel 305 is rotatable about an axis perpendicular to the longitudinal axis of the grenade by means of two very thin, diametrally opposed pivots 306 constituted by two thin pointed elements protruding from the surface of the barrel, the said pivots being accommodated in two longitudinal, diametrally opposed slots 307 of a stationary portion 330 of the grenade body, which is also provided with a passage 310 leading to the explosive charge 304. The slots 307 of the member 330 are normally closed at their top by a shoulder of a stationary portion 331 of the nose fuze. It will be noted that the portions 302, 330 and 331 of the grenade nose are tightly fitted into one another as shown in the drawings.

The device for blocking the striker in its safety position comprises a first inertia block 315 accommodated in the striker 301 and slidingly movable within the latter between a first, front position defined by the striker plug 335 and a rear position defined by the striker bottom. A return spring 316 is placed between the inertia block 315 and the striker bottom and pushes the said block towards the plug 335.

A second inertia block 341 is placed around the striker 301 within the member 302 and is substantially in the shape of a ring of small height and very small weight. A resiliently compressible element 322 constituted by an O-ring seal is placed between the inertia block 341 and an internal upper shoulder 319 of member 302. The said O-ring does not fulfill the function of a compression spring but only that of a resiliently compressible member, the normal condition of which is shown in FIGS. 3 and 4.

In the compressed condition shown in FIG. 2 the deformed O-ring 322 sealingly bears upon the outer cylindrical wall of striker 301. On the contrary, when the O-ring 322 reassumes its initial shape shown in FIGS. 3 and 4 it no longer bears upon the striker 301, thus allowing the latter to slide without friction.

A sleeve 317 placed under the second inertia block 341 rests upon the upper portion of member 331 and is intended to limit the downward movement of the block 341 as seen in FIG. 3.

In the tubular wall of striker 301 are provided at least two, e.g., diametrally opposed, holes 324 intended to receive blocking balls 325. The holes 324 seen in longitudinal section have a tapering shape from the inner surface to the outer surface of the striker 301.

The barrel 305 is provided, on its portion opposite to its portion provided with the blind hole 312 into which the pointed protuberance 334 of the striker engages, with an element 308 which is for example annular in shape or may have any other suitable shape and which is mounted in a recessed portion of barrel 305. The element 308 is made from heavy, preferably stainless metal. The ring 308 protrudes from the substantially spherical surface of the barrel so as to bear with its outer bevelled edge on the bottom of the cavity 309 containing the barrel, when the latter is in its safety position shown in FIGS. 2 and 3.

The ring 308 contributes to unbalance the barrel which thus constitutes a compound pendulum whose center of gravity is shifted with respect to its axis of rotation.

It will be noted that the ring 308 also prevents or reduces the possible adherence of the barrel 305 to its seat on the member 330 as a result of chemical corrosion or of a trace of soil between the contacting surfaces.

Furthermore, when the barrel is in its safety position, the ring 308 co-operates with an abutment 300 provided at the bottom of cavity 309 and constituted for example by an insert placed in a hole drilled in member 330.

The function of the abutment 300 is to prevent any rotation of barrel 305 in the wrong direction when the latter is released by the striker 301. In particular, the location of the abutment 300 is not chosen at random. It must be opposite, with respect to the longitudinal axis 11 of the grenade, to the notch 7 formed in the end of the tail tube 4. Indeed, as pointed out previously, the preferential outlet for the propelling gases through the notch 7 results in a lateral impulse applied to the grenade and diagrammatized by arrow 9, which tends to modify the inclination of the grenade at the outset of its trajectory. At the moment the barrel 305 is released by the striker, it has exactly the same angular speed as the grenade, and when the lateral impulse materialized by arrow 9 ceases, the barrel released by the striker tends to rotate in the same direction. This favors or on the contrary opposes its normal rotation allowing it to pass from its safety position to its operating position, and it is important to eliminate this inaccuracy. This precisely is the function of the abutment 300 which is placed, with respect to the longitudinal axis 11 of the grenade, on the side opposite to the side where the notch 7 is located, in order to prevent the barrel 305 from rotating in the opposite direction to its normal direction of rotation, at the moment the lateral impulse 9 disappears.

It is therefore understood that the notch 7 at the end of the tail tube 5 and the presence of the abutment 300 allow the grenade to be imparted at the beginning of its trajectory an additional inclination of predetermined maximum value, and on the other hand, the accuracy of the duration of rotation of the barrel between its safety position and its operating position to be increased.

It will be noted that, in the form of embodiment just described, it is possible not to provide the inertia block 315 with the upper portion 353 shown in the drawing, so that the inertia block stops at the level of the top of the skirt 352. In this case, the upper portion of the holes 324 of the striker may be cut obliquely to form an inclined guiding surface directed upwardly and inwardly of the striker, so that the balls 325 are naturally guided towards the inside of the striker when the inertia block moves down towards the bottom of the striker and releases the balls. The latter thereafter remain within the striker, above the inertia block 315, which can therefore rise again and return to its initial position under the action of its return spring.

Lastly, in this form of embodiment and in the one that will now be described, the sleeve 317 may be replaced by inwardly projecting bosses on the inner surface of portion 302.

The invention also proposes means for increasing the period of time between the moment the grenade is discharged and the moment the striker releases the barrel 305 and thereafter allows it to rotate from its safety position to its operating position.

It has indeed been found that the lower portion of striker 301, which is guided in an axial bore 350 of the member 331, plays in that bore the role of a piston when passing from its safety position into its operating position. There are therefore provided means for substantially sealingly closing the cavity 309 containing the barrel 305, on the one hand by mounting the striker 301 with a small sliding clearance or play in the bore 350, and, on the other hand, by closing by means of a thin wall 351 the upper end of the passage 310 leading to the charge 304. This thin wall will be burst or destroyed, when the grenade is fired, by the explosion of the detonator 303. The cavity 309 thus separated from the charge 304 can advantageously be filled together with the other cavities with an inert and dry gas on mounting the nose of the grenade, thus making unnecessary the use of stainless metals.

It is understood that the striker, in passing from its safety position illustrated in FIGS. 2 and 3 to its operating position shown in FIG. 4, tends to create a partial vacuum in the cavity 309, thus slowing down its movement. The small sliding play of the striker 301 in the bore 350 allows calibrated air-inlet orifices to be formed in the cavity 309, so that the movement of the striker 301 is not slowed down too much and the striker moves to its endmost front position shown in FIG. 4.

This movement of the striker must be prevented from being accelerated by the movement of the inner inertia block 315 when the latter is pushed by its return spring 316. To this end, the invention provides for a special shape of the inertia blocks 315 and 341 as well as a particular shape of the holes 324 accommodating the balls 325.

According to the invention, the inner inertia block 315 comprises a lower cylindrical skirt 352 of great length and substantially equal or slightly smaller in diameter than the inner diameter of the striker 301, and an upper, e.g., cylindrical, portion 353 of reduced diameter and small height.

The inner surface of the second inertia block 341 comprises a cylindrical upper portion 354, a lower cylindrical skirt 355 larger in diameter, and an inclined wall 356 connecting the cylindrical portion 354 to the skirt 355. The inner diameter of the skirt 355 is equal to the outer diameter of the skirt 352 of the first inertia block 315, plus twice the diameter of the balls 325.

It will be noted that the second inertia block 341 is generally shaped as a ring of small height and very reduced weight. The lightness of the inertia block 341 is of essential importance, since, if the grenade is fired with a ball cartridge and a ball trap, the instantaneous acceleration to which the mechanism is subjected approximates to 100,000 g (g being the normal gravity acceleration).

In the safety position illustrated in FIG. 2, the inertia block 315 pushed by its spring 316 abuts against the plug 335 of the striker, its skirt 352 holds the balls 325 engaged in the holes 324 and projecting outwardly of the striker 301. The balls 325 are held in place by the inner inclined wall 356 of the second inertia block 341 which itself bears upon the O-ring 322, thus deforming the latter.

Lastly, it will be noted that the striker 301 is provided with a return spring 360 placed between the upper portion of the member 331 and an abutment or collar 361 provided on the striker. The upper end of the striker slides in the cylindrical orifice of the upper portion of the member 302. In the safety position the return spring 360 of the striker is compressed as seen in FIG. 2.

On discharging the grenade, the acceleration acting upon the latter causes the first inertia block 315 to move down to the bottom of the striker and the return spring 316 to be compressed. The skirt 352 of the inertia block 315 is moved below the holes 324 of the striker, as shown in FIG. 3, the balls 325 are pushed by the inclined wall 356 of the second inertia block 341 (the O-ring 322 expands and the acceleration pushes the inertia block 341 downward) and the frusto-conical shape of the holes 324 guides the balls 325 outward of the striker until the said balls bear upon the cylindrical upper portion 353 of the inertia block 315. The cylindrical portion 354 of the second inertia block 341 is then substantially opposite the holes 324 and prevents the balls 325 from moving outward again. The inertia block 315 is thus locked in the bottom of the striker and its return spring 316 remains compressed.

At the end of acceleration the striker 301 pushed by its return spring 360 tends to be extracted from the bore 350, thus producing a partial vacuum in the cavity 309 containing the rotary barrel 305. The annular clearance between the striker and the wall of the bore 350 allows the forward movement of the striker to be slowed down, without however opposing it too much.

The striker thus reaches its operating position shown in FIG. 4, the inertia block 315 being retained in the bottom of the striker by the balls 325 engaged in the holes 324 and against the cylindrical upper portion 353 of reduced diameter of the said first inertia block.

It will be noted that the inertia block 315 is traversed by an axial bore 370 allowing this block to move down to the bottom of the striker without being hampered by air compression between the said block and the bottom of the striker.

Likewise, in order that, in firing the grenade, the sinking of the striker may not be hampered by the compression of the air or the gas in the cavity 309, there can be provided in the bottom of the striker a through hole 371 normally closed by a plate 372 resiliently urged to the closed position by the spring 316. The hole 371 and the plate 372 thus constitute a non-return or check valve.

It is understood that the above-mentioned new means of the invention allow the movement of the striker from its safety position to its operating position to be efficiently slowed down, on the one hand by causing it to fulfill the function of a piston sucking the air or gas from the cavity 309 and on the other hand by preventing the inertia block 315 from abruptly returning under the action of its return spring 316.

Of course, the invention is by no means limited to the form of embodiment described and represented which has been given by way of example only. In particular, it comprises all the means constituting technical equivalents of the means described, as well as their combinations should the latter be carried out according to its gist and used within the scope of the following claims.

What is claimed is:

1. A rifle grenade having an orifice or passage with edges leading to the explosive charge thereof, comprising a tail tube and a nose fuze provided with a delay-action firing mechanism including a striker arranged along the axis of the grenade and protruding beyond the front of the grenade, a detonator carried by a barrel and associated with the striker so as to be fired when the front of the grenade meets an obstacle, a charge fired by the detonator and a striker blocking device with inertia unlocking on shooting of the grenade, the said device being intended to hold the striker and the detonator in a safety position so long as the grenade has not been fired and for a certain time after the shooting of the grenade, wherein the barrel is provided with an annular or otherwise suitably shaped element, made for example at least partially from stainless metal, attached to and protruding from the barrel to form a surface by which the latter in safety position bears upon the edges of the orifice or passage leading to the explosive charge of the grenade, the said annular element, when the barrel is in its safety position, bearing upon a first stationary abutment preventing the barrel from rotating in the wrong direction when it is released by the striker.

2. A grenade according to claim 1, wherein the said annular element attached to the barrel bears upon a second abutment of the grenade body, intended to hold the barrel in its operating position.

3. A grenade according to claim 1, wherein the tail tube of the grenade, by means of which the latter is fitted to the rifle barrel, is provided with an outlet opening for the propelling gases, the said opening being so directed as to impart a predetermined maximum-value inclination to the grenade at the beginning of its trajectory.

4. A grenade according to claim 3, wherein the said opening is formed by a notch or cut, e.g., semi-circular in shape, provided at the end of the tail tube of the grenade.

5. A grenade according to claim 3, wherein the said opening is provided, with respect to the longitudinal axis of the grenade, on the side opposite to the side where the said first abutment, upon which bears the annular element of the barrel in safety position, is located.

6. A grenade according to claim 1, wherein the cavity of the grenade body, in which is accommodated the barrel, is substantially sealingly separated from the explosive charge by a thin wall closing the passage leading to the explosive charge, the said thin wall being intended to burst or be destroyed upon firing by the explosion of the detonator contained in the barrel.

7. A grenade according to claim 6, wherein the bottom of the striker is provided with a hole closed resiliently within the striker by a plate, thus forming a non-return or check valve.

8. A grenade according to claim 6, wherein the clearance between the striker and the wall of the bore of the grenade body, which connects the grenade nose to the cavity containing the barrel, forms a calibrated air passage allowing the displacement of the striker from its safety position to its operating position to be slowed down.

9. A grenade according to claim 6, wherein at least the cavity containing the barrel is filled with inert and dry gas.

10. A grenade according to claim 1, wherein the device for blocking the striker in safety position comprises a first inertia block movable within the striker between a front abutment and the bottom of the striker, a return spring arranged between the first inertia block and the bottom of the striker, a second annular cylindrical inertia block surrounding the striker and movable between a resiliently compressible annular element surrounding the striker and a rear abutment, holes or apertures formed in the wall of the striker to accommodate blocking balls held in the said holes or apertures between the said first and second inertia blocks so as to retain the striker in its safety position, the outer wall of the first inertia block comprising an inner cylindrical skirt whose diameter is substantially equal to or slightly smaller than the inner diameter of the striker, and an upper portion of reduced diameter, whereas the inner wall of the second inertia block comprises a cylindrical upper portion whose diameter is slightly greater than the outer diameter of the striker, and which is prolonged downward by a lower cylindrical skirt of greater diameter, so that in the safety position of the detonator the blocking balls are held by the cylindrical skirt of the first inertia block in the said holes or apertures of the striker and within the lower cylindrical skirt of the second inertia block, whereas on shooting the grenade the cylindrical upper portion of the second inertia block pushes the balls into the holes or apertures of the striker against the upper portion of reduced diameter of the first inertia block which is thus held locked by the balls in the bottom of the striker against the action of its return spring.

11. A grenade according to claim 10, wherein the striker is surrounded by a return spring placed between a stationary portion of the grenade body and a front abutment or collar of the striker so as to urge the latter towards its operating position.

12. A grenade according to claim 10, wherein the first inertia block has a relatively important travel within the striker and the useful length of its lower cylindrical skirt is such that, on shooting the grenade, the first inertia block must accomplish its whole travel before the striker can be released.

13. A grenade according to claim 10, wherein the inner diameter of the lower cylindrical skirt of the second inertia block is substantially equal to the outer diameter of the lower cylindrical skirt of the first inertia block plus twice the diameter of the balls.

14. A grenade according to claim 10, wherein the diameter of the cylindrical upper portion of the first inertia block is substanitally equal to the diameter of the lower cylindrical skirt of the said inertia block, less the diameter of the balls.

15. A grenade according to claim 10, wherein the holes or apertures of the striker are for example substantially frusto-conical in shape and widen in the direction from the outside towards the inside of the striker.

16. A grenade according to claim 10, wherein the cylindrical upper portion of the inner wall of the second inertia block is connected to the said lower cylindrical skirt by an inclined surface.

17. A grenade according to claim 10, wherein the first inertia block is axially traversed by a bore.

18. A grenade according to claim 10, wherein the said second inertia block is constituted by a ring of very small height which surrounds the striker and, when the striker is in its operating outer position, bears upon a sleeve resting through its lower end upon an internal shoulder of the body of the projectile.

19. A grenade according to claim 18, wherein the resiliently compressible element associated with the second inertia block is constituted by an O-ring seal compressed by the second inertia block on the striker in the firing mechanism locking position and releasing the striker when the said mechanism is unlocked.

20. A grenade according to claim 10, wherein the first inertia block is not provided with the said upper portion of reduced diameter and that the holes or apertures of the striker wall comprise an obliquely-cut upper portion forming a guiding surface directly upwardly and inwardly of the striker, so as to allow it to push the balls into the striker.

* * * * *